US012385275B2

(12) United States Patent
Lakshminarayanan

(10) Patent No.: US 12,385,275 B2
(45) Date of Patent: Aug. 12, 2025

(54) PORTABLE CARPORT

(71) Applicant: Sriramkumar Lakshminarayanan, San Ramon, CA (US)

(72) Inventor: Sriramkumar Lakshminarayanan, San Ramon, CA (US)

( * ) Notice: Subject to any disclaimer, the term of this patent is extended or adjusted under 35 U.S.C. 154(b) by 240 days.

(21) Appl. No.: 18/337,361

(22) Filed: Jun. 19, 2023

(65) Prior Publication Data

US 2024/0417991 A1 Dec. 19, 2024

(51) Int. Cl.
*E04H 6/04* (2006.01)

(52) U.S. Cl.
CPC ..... *E04H 6/04* (2013.01)

(58) Field of Classification Search
CPC ..... E04B 1/34305; E04D 1/34; E04F 10/10
See application file for complete search history.

(56) References Cited

U.S. PATENT DOCUMENTS 5,109,643 A * 5/1992 Speers ..... F21V 19/0005 52/28
5,839,462 A 11/1998 Randall
6,230,783 B1 * 5/2001 Frey, Jr. ..... E04F 10/0648 160/67
7,913,710 B2 * 3/2011 Bougioukos ..... E04H 15/18 135/94
10,344,494 B2 7/2019 Volin
10,352,057 B2 7/2019 May
11,193,293 B2 12/2021 Kent
11,515,833 B1 11/2022 Ginsberg-Klemmt
11,530,546 B1 * 12/2022 Negron ..... E04H 6/04
2004/0221965 A1 * 11/2004 Wagner ..... E04F 10/0625 160/67
2016/0289989 A1 * 10/2016 Creagh ..... E04H 6/04
2019/0062101 A1 * 2/2019 Bielfelt ..... B63B 17/02
2020/0181918 A1 * 6/2020 Auer ..... E04B 1/34321
2021/0131091 A1 * 5/2021 Sakaguchi ..... E04H 6/025
2022/0412114 A1 * 12/2022 Wastel ..... E04H 6/424
2023/0037899 A1 * 2/2023 Alalwan ..... E04H 15/04
2023/0313519 A1 * 10/2023 Tarak ..... E04B 1/2403 52/79.6

* cited by examiner

*Primary Examiner* — Beth A Stephan
(74) *Attorney, Agent, or Firm* — Ivan E. Rozek; Savantek Patent Services

(57) ABSTRACT

A portable carport where vertical support members can be set up by one or more people and a horizontally disposed roof assembly attached to vertical support members, the roof assembly allowing an accordion style roof member to automatically extend or retract from the vertical support members when a person presses a button on a handheld transmitter that sends a radio signal to a receiver that is connected to a battery and motorized extension arm assemblies which can extend the roof and connected side panels forming protection for vehicle from sun and or rain. The roof assembly and side panels can be brought back to their original stored position when not needed. The roof assembly further comprising solar photovoltaic panels enabling the carport to be operable when line power is not available.

6 Claims, 14 Drawing Sheets

PORTABLE CARPORT

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of carports and more specifically to a portable carport that can be set up by an individual and used to protect his or her vehicle from sun and rain.

Carports are a well-known form of vehicle protection and usually involve a number of vertically oriented support structures fixed into the ground and terminating at their upper end in a roof like structure to protect a vehicle from direct sun and rain. Some carports may include side panels but are not as all-encompassing as a typical garage structure. Oxford dictionary defines a carport as a shelter for a car consisting of a roof supported on posts, built beside a house. Other carports include tent-like structures that are made of a structural tubing frame and a fabric cover.

However, none of the current carports available in the market describe a portable carport that allows the user to extend the roof and side walls of the carport when needed and retract the roof and side walls when not needed. Such an assembly would make it possible for a person to provide a garage-like structure in a driveway of a home or office when needed, but to have the structure take up minimal visual and physical space when not needed.

BRIEF SUMMARY OF THE INVENTION

A portable carport that can be assembled by one or more individuals in his or her driveway or other location near a home or office that can be stored in a retracted state when not in use and can be extended for use as a carport when so desired.

An object of the invention is to provide a portable carport that includes an extendable roof, preferably an accordion style roof, and foldable side panels that can be automatically extended to act as a carport or retraced to reduce the visual and physical space used by the carport when not in use. In one embodiment, a roof member deployment mechanism comprises a motor powered retracting and extending telescoping tubes which provide the extending and retracting mechanism. In another embodiment a right and a left motorized swing arms provide the extending and retracting mechanism.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a portable carport having a plurality of vertical support posts, the bottom of each post connected to a weighted base assembly and the upper portion of each posts connected to a horizontally disposed structure which retains an extendable accordion type roof member. The roof structure also supports an extendable accordion type or a roll up type side and front panels. The roof member and side panels are constructed to extend and to retract by an electrically powered motorized mechanism.

Two preferred embodiments of the extend and retract mechanism are: a plurality of extending and retracting telescoping tubes, or a left and a right mirror image horizontally rotating swing arms slidably attached to a bar that is forming the front of the horizontally disposed roof member.

The roof member deployment mechanism motors are powered by a battery which is being recharged by either one or more solar panels mounted to the roof of the horizontally disposed enclosure or by a charger attached to line power.

It can be seen from the following description and claims that the portable carport can be also used as a portable temporary storage in general.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments of the invention are provided herein. It is to be understood, however, that the present invention may be embodied in various similar forms. Therefore, specific details disclosed herein are not to be interpreted as limiting, but rather as a basis for the claims and as a representative basis for teaching one skilled in the art to employ the present invention in virtually any appropriately detailed system, structure, or manner.

Figure 1:
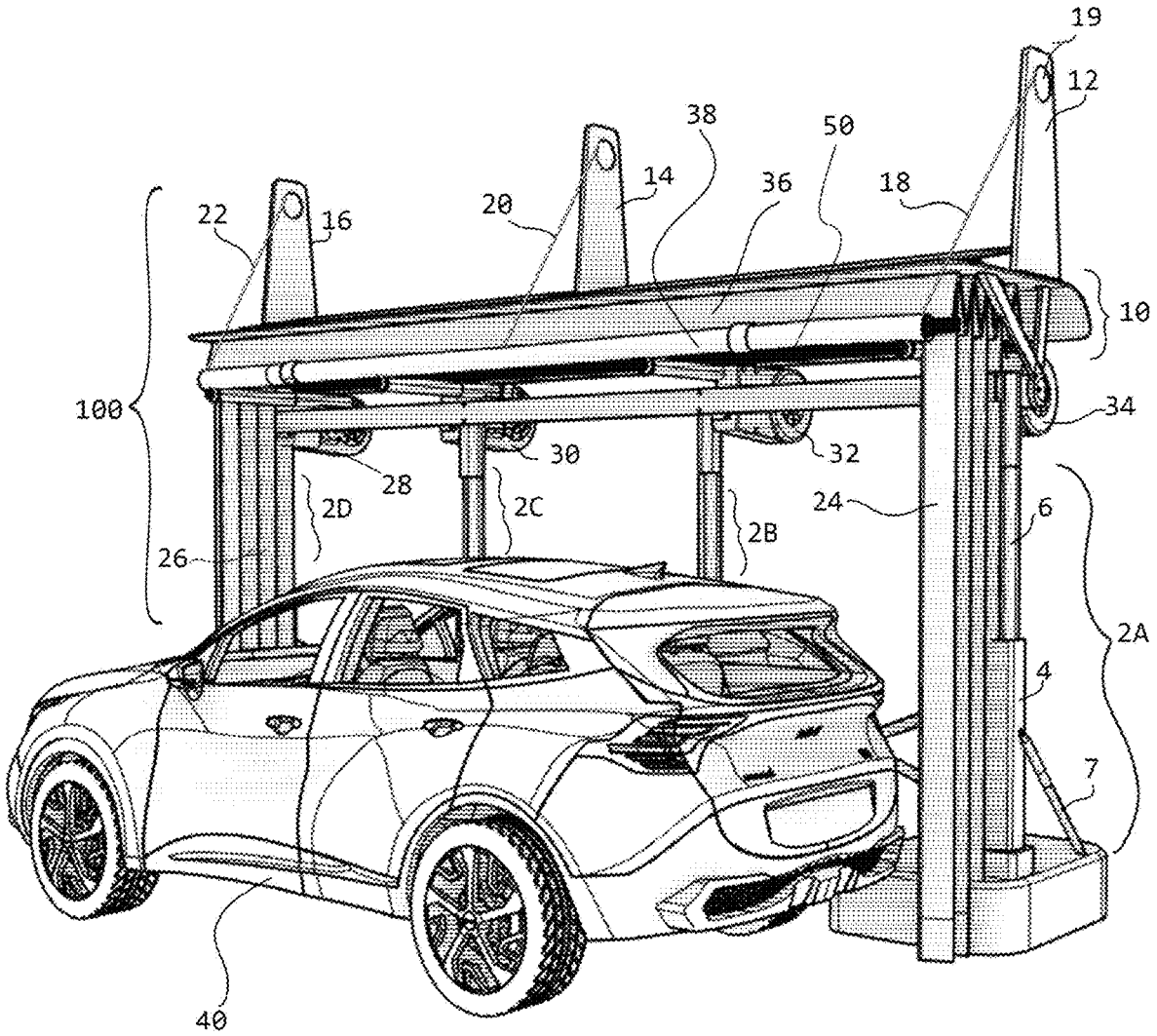
FIG. 1 is a front perspective view of the telescoping tubes embodiment, accordion folding roof shown in the retracted condition with a vehicle in place ready to be covered by the carport of the present embodiment.

Referring now to FIG. 1 we see a perspective view of the telescoping tube embodiment of the portable carport 100. A plurality of vertical support posts 2A, 2B, 2C, and 2D are forming the rear of the carport. The vertical support posts 2A, 2B, 2C, and 2D support a horizontally disposed assembly that includes a protective cover panel 10, an accordion style roof member 36 and other elements which will be discussed in subsequent Figures. Each support post 2 is comprised of a weighted base assembly 8, a lower post tube 4 and an upper post tube 6. A motorized telescoping mechanism 28, 30, 32, 34 can be seen at the top of each support post assembly 2A. Raised support arms 12, 14, 16 each have a spring reel assembly 19 located near the top of each support arm 12, 14, 16 that allows a cable 18 to extend or retract from spring reel 19 as needed. The carport of the present invention can be implemented in various sizes, the present embodiments are designed to accommodate vehicles 40 requiring approximately a seven by fifteen enclosure, or a smaller vehicle, as the case may be.

An SUV type vehicle shown in the drawings describing the instant inventions is not be construed as limiting; the instant inventions can be scaled to various sizes to accommodate for storage various cars and/or other equipment. All the components of the portable carport are designed to be relatively lightweight and capable of being assembled by one or two people, preferably in less than one hour. The carport of the present invention is designed to be typically installed in a driveway area of a home or office allowing the user to deploy the roof 36 and curtains 24, 26 and front curtain 38 as needed to protect a vehicle from sun and rain, and to return the roof and side curtains to stored positions when not needed.

Figure 2:
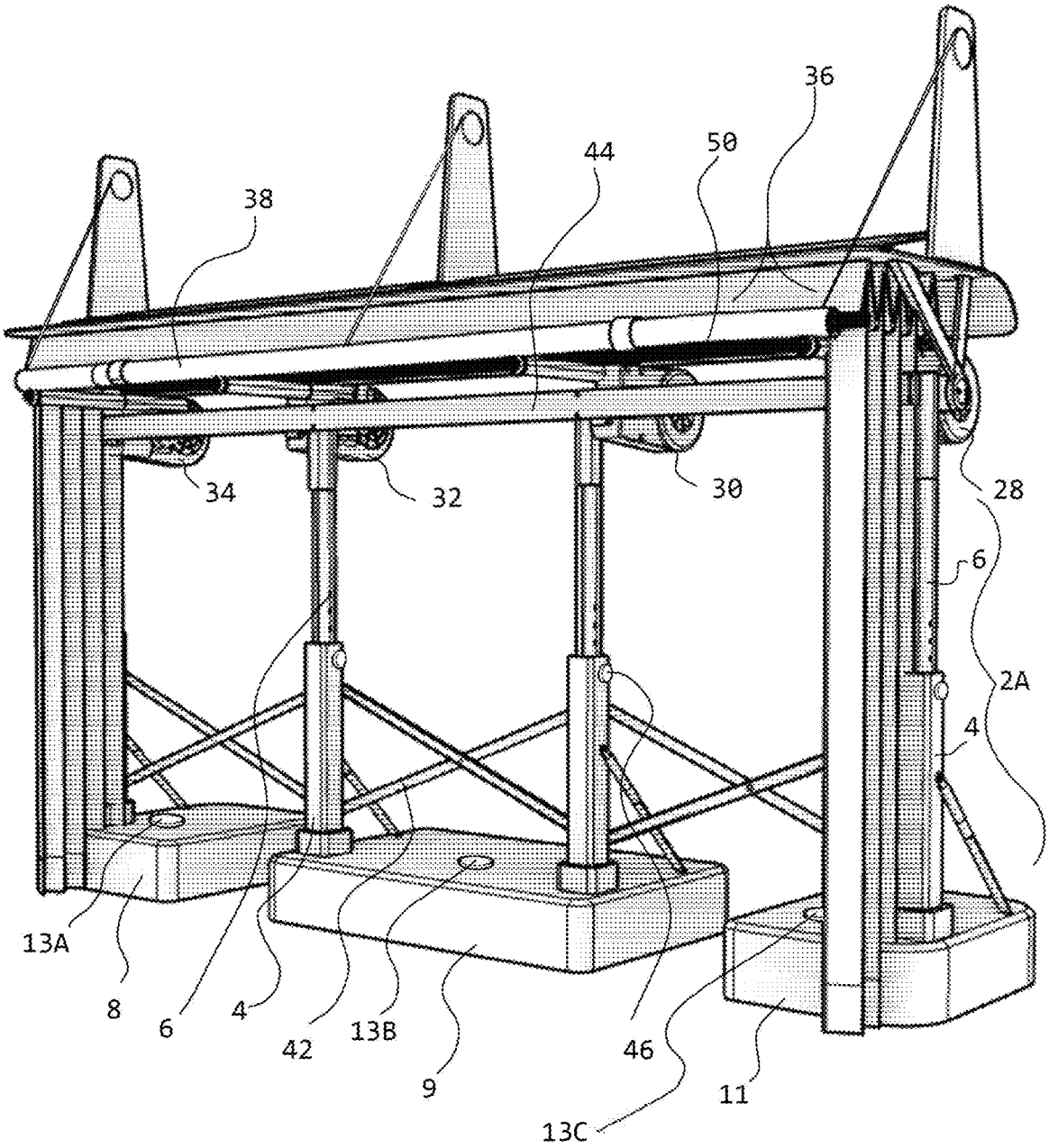
FIG. 2 is a front perspective view of the embodiment with the accordion folding roof in the retracted condition without a vehicle in place.

FIG. 2 is a perspective view of the carport embodiment 100 without a vehicle in place. Weighted base assemblies 8, 9, 11 can be clearly seen. The hollow base members can be filled with water or sand that can be introduced through capped orifices 13. Reinforcing struts 42 help prevent the support posts 2A from moving to the left or right. Adjustment knobs 46 allow the user to raise or lower the support posts 2A to accommodate various heights of vehicles that may be parked under the roof portion 36 by allowing upper tube 6 to slide and lock in place with lower tube 4.

Figure 3:
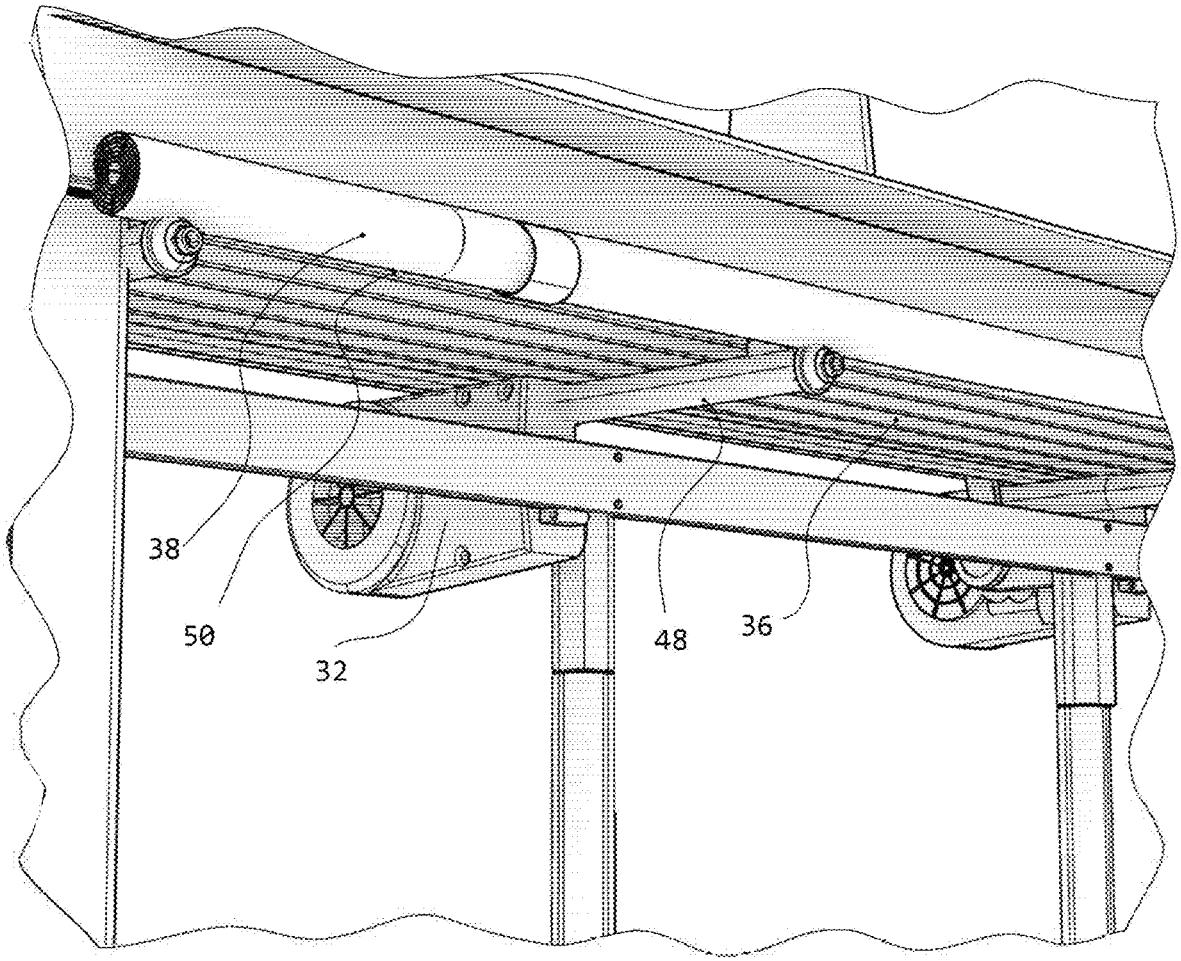
FIG. 3 is a partial perspective view of the retracted roof and telescoping extension and retraction assembly.

FIG. 3 is a partial perspective view of the embodiment 100 showing telescoping tube assembly 32 with its tube 48 in the retracted position. The front of tube 48 is fixedly attached to a horizontal roof member 50. A rolled curtain 38 is attached to the front surface of horizontal member 50. Curtain 38 is constructed in a similar way to a standard window curtain that includes a hollow tube with a long torsion spring inside that allows the curtain to automatically be returned to its stored position when not needed for enclosing the carport.

Figure 4:
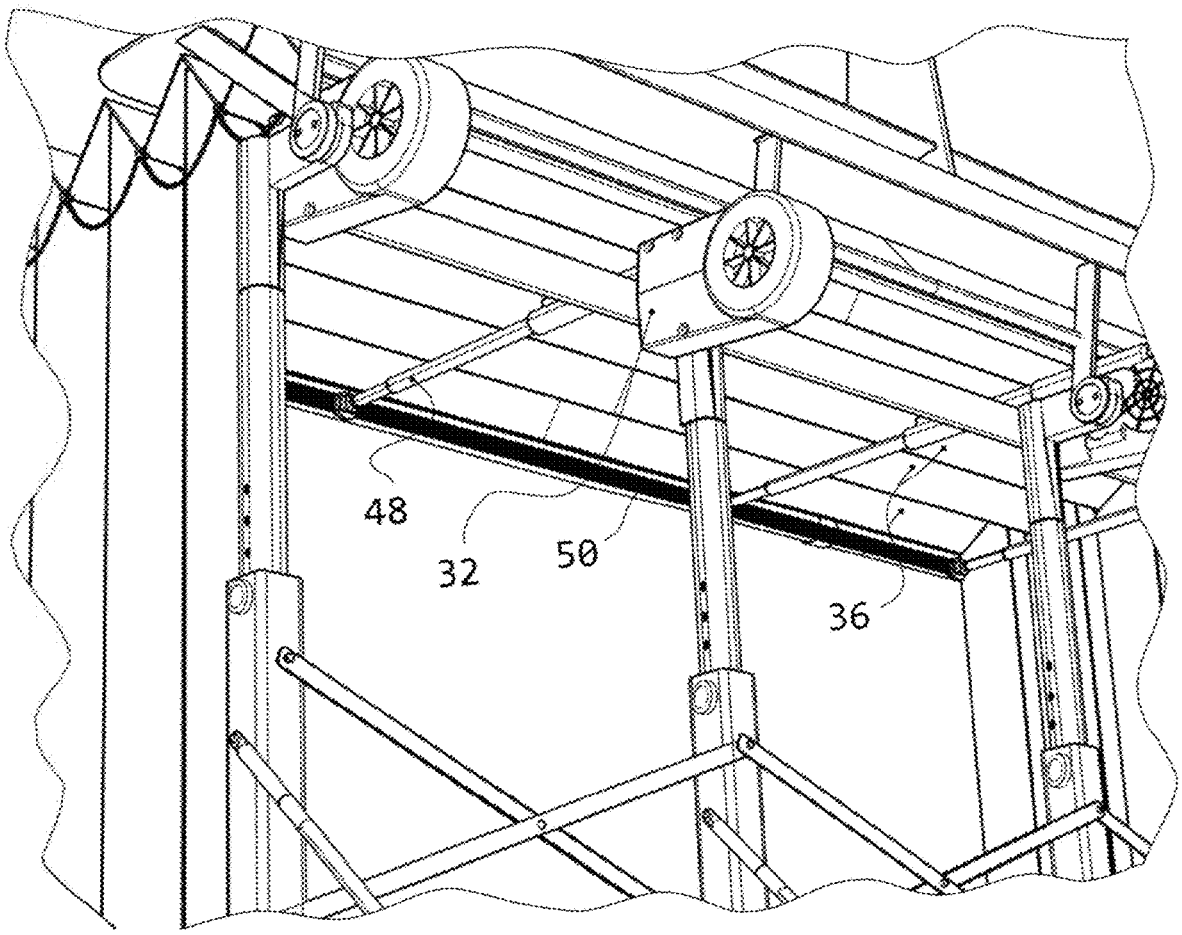
FIG. 4 is a partial perspective view of the roof partially extended.

FIG. 4 is a partial perspective rear view of the embodiment 100 with the telescoping tubes 48 in a partially extended condition thereby drawing accordion roof member 36 out. Each telescoping mechanism 32 includes an electric motor and an internal coiled plastic cable similar to that found in a power antenna. The electric motors are activated by a remotely handheld transmitter that sends a signal to a receiver. The receiver then instructs the motors to cause the telescoping arms 48 to extend or retract as needed. The ends of the telescoping arms 48 can be clearly seen to be attached to horizontal roof support member 50.

Figure 5:
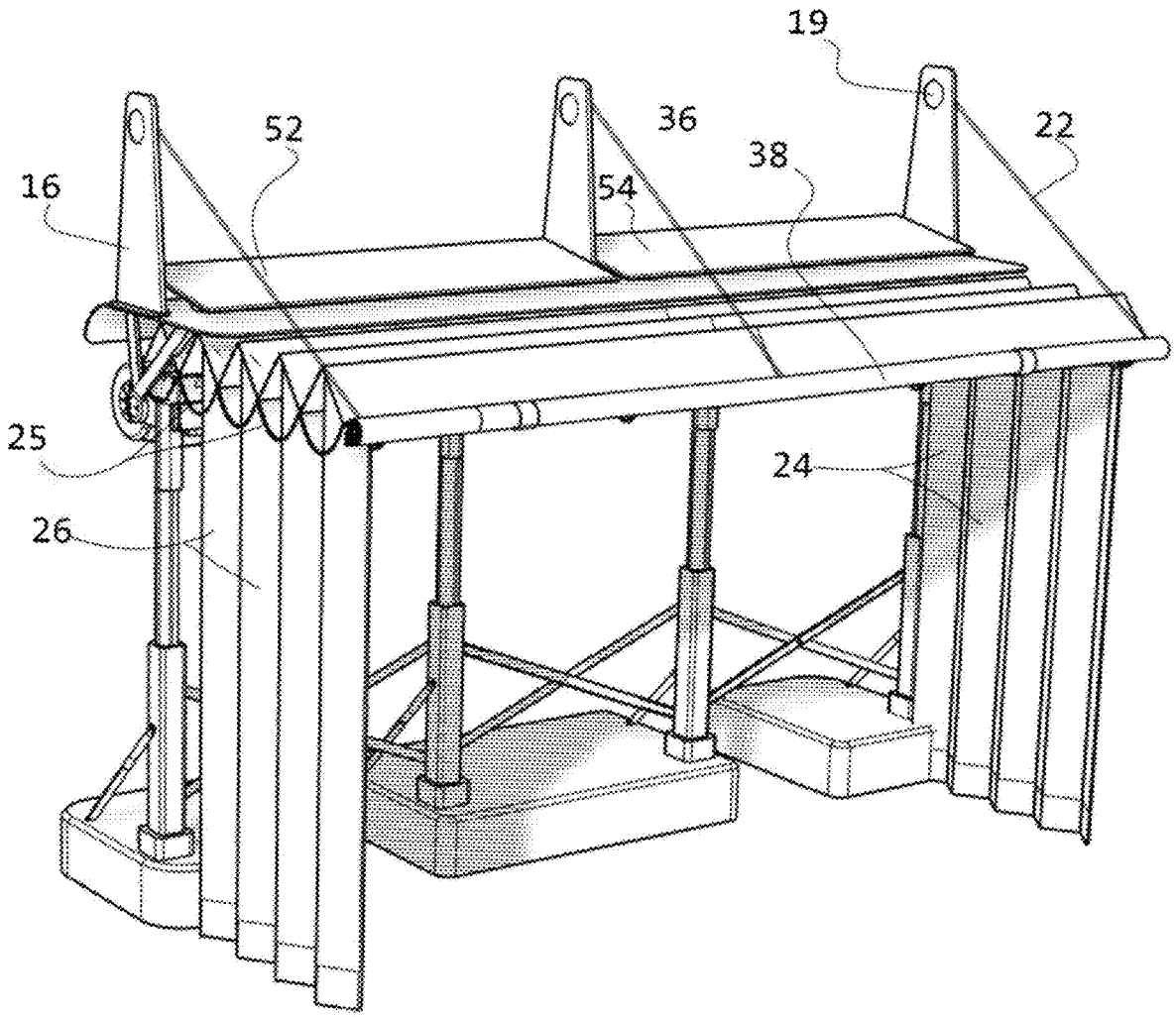
FIG. 5 is a partial perspective view of the side walls partially extended.
Figure 6:
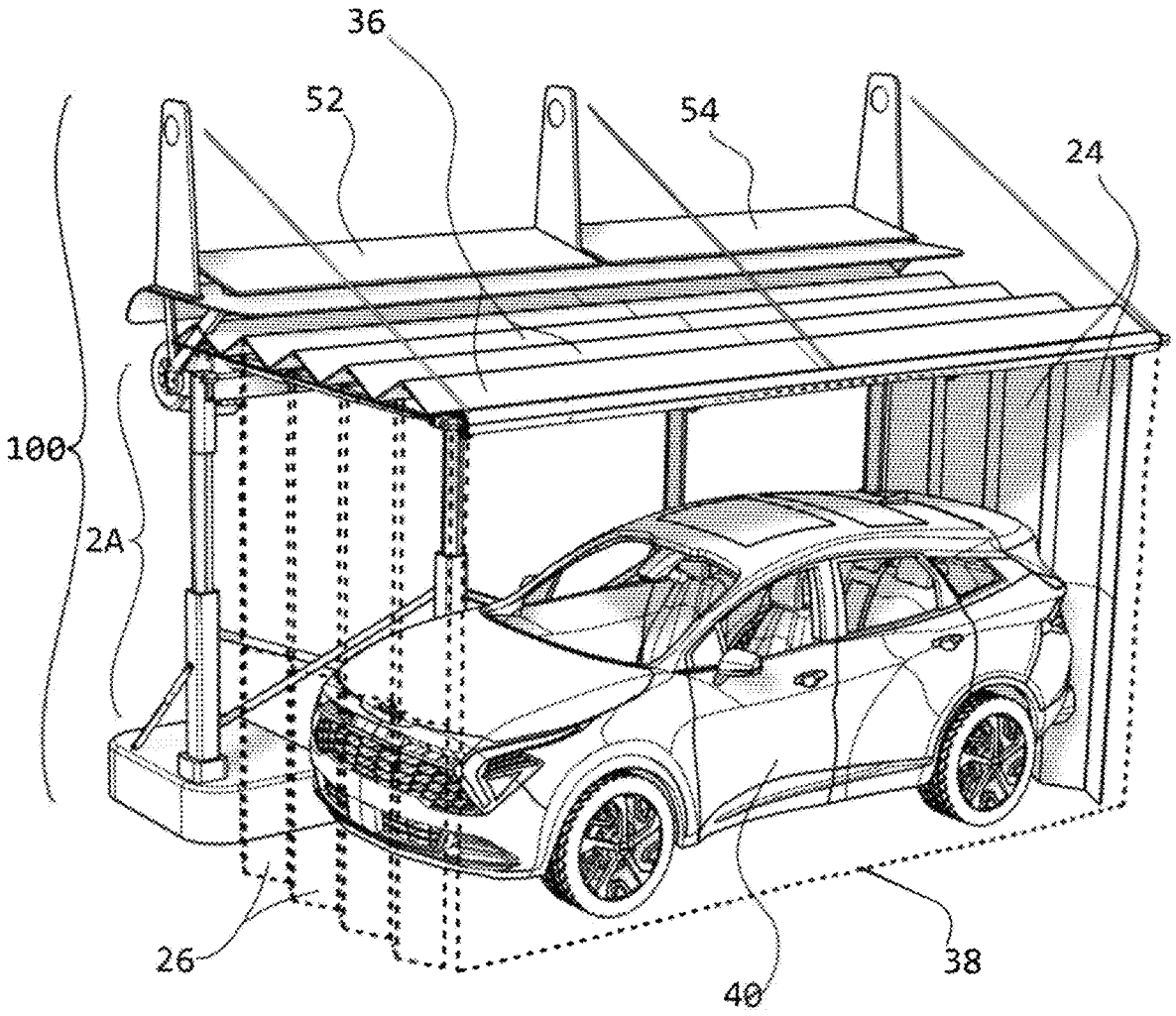
FIG. 6 is a perspective view of the roof and side walls fully extended with a vehicle stored underneath the roof.

FIG. 5 is a front perspective view of the carport embodiment 100 with the roof member 36 in a partially extended condition. Side curtains 24, 26 are attached to roof member 36 so that as the roof 36 extends, the side curtains 24, 26 also extend to form the left and right walls of the carport 100. Cables 22 extend out as the roof member 36 extends out. Bead chain 25 also extends until it becomes taught as shown in FIG. 6. The bead chain 25 ensures that each section of the accordion roof 36 and side curtains 24, 26 is uniform in shape. Solar photo voltaic panels 52, 54 can supply power to a DC battery which in turn powers the motors in telescoping assemblies 28, 30, 32, 34.

FIG. 6 is a perspective view of the embodiment 100 where the roof member 36 is fully extended and the front curtain 38, shown in dotted line, has been pulled down as well as side curtains 24, 26 shown in dotted line being pulled out thereby enclosing vehicle 40 and protecting if from sun and rain. An optional rear curtain, not shown, can be added to fully enclose the vehicle. The rear curtain can remain in place at all times by attaching it to the vertical support members 2.

Figure 7:
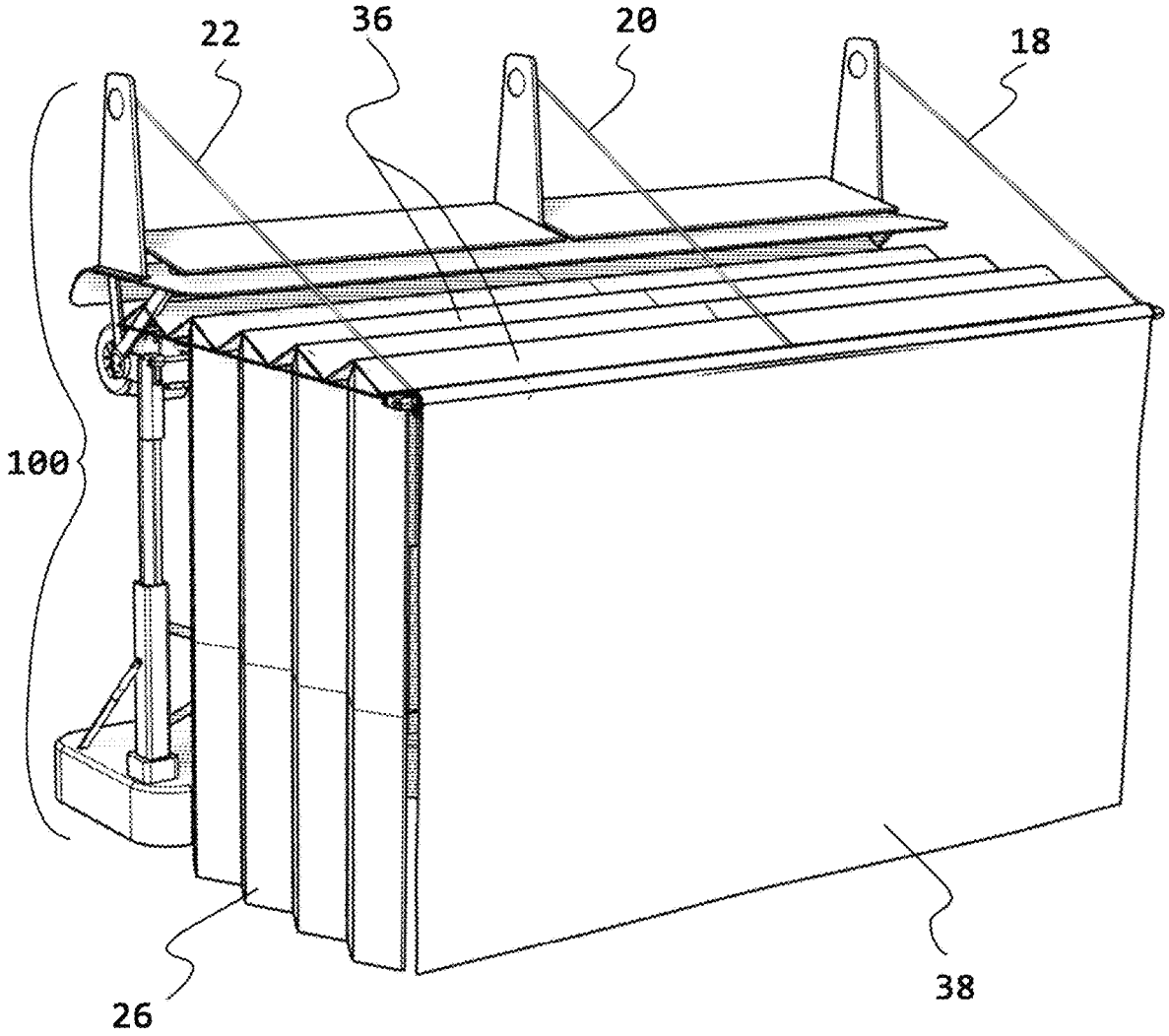
FIG. 7 is a perspective view of the carport showing the front and side walls fully deployed.

FIG. 7 is a perspective view of the carport 100 where a vehicle is completely covered by the roof member 36 and side curtains 24, 26 and front curtain 38 Cables 18, 20, 22 have been pulled out to their maximum length thereby providing a physical support for the front portion of roof member 36 keeping the roof member 36 in the horizontal plane regardless how far it is being extended.

Figure 8:
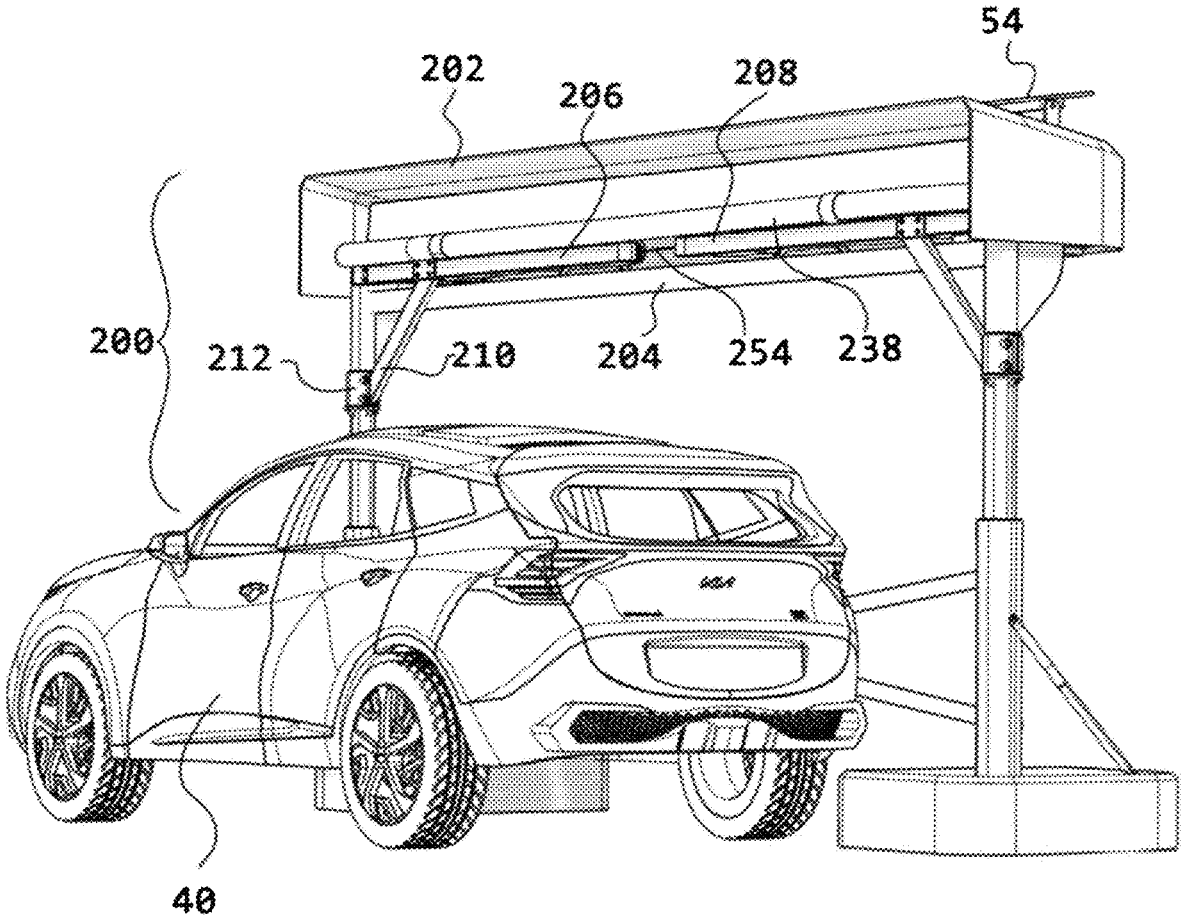
FIG. 8 is a perspective view of the rotating swing arm embodiment that uses left and right mirror image arms to deploy the roof and side panels, the carports being shown in its retracted state.

FIG. 8 is a swing arm embodiment of the portable carport, embodiment 200, where an alternate roof supporting structure includes right and left mirror image swing-out arms 206, 208. The arms 206, 208 are rotatably supported by struts 210 and collar 212. Two swing-out arms are shown; however, the design can be extended to more than two swing-out arms and posts. The ends of arms 206, 208 are slidably connected to front horizontal support member 254. The front of roof 36 is attached to front horizontal support member 254. A protective enclosure 202 helps keep the entire roof assembly clean and dry when not in active use. Other components of the carport such as the vertical support posts and accordion type roof are the same as in the telescoping tube embodiment 100 shown in FIGS. 1 through 7.

Figure 9:
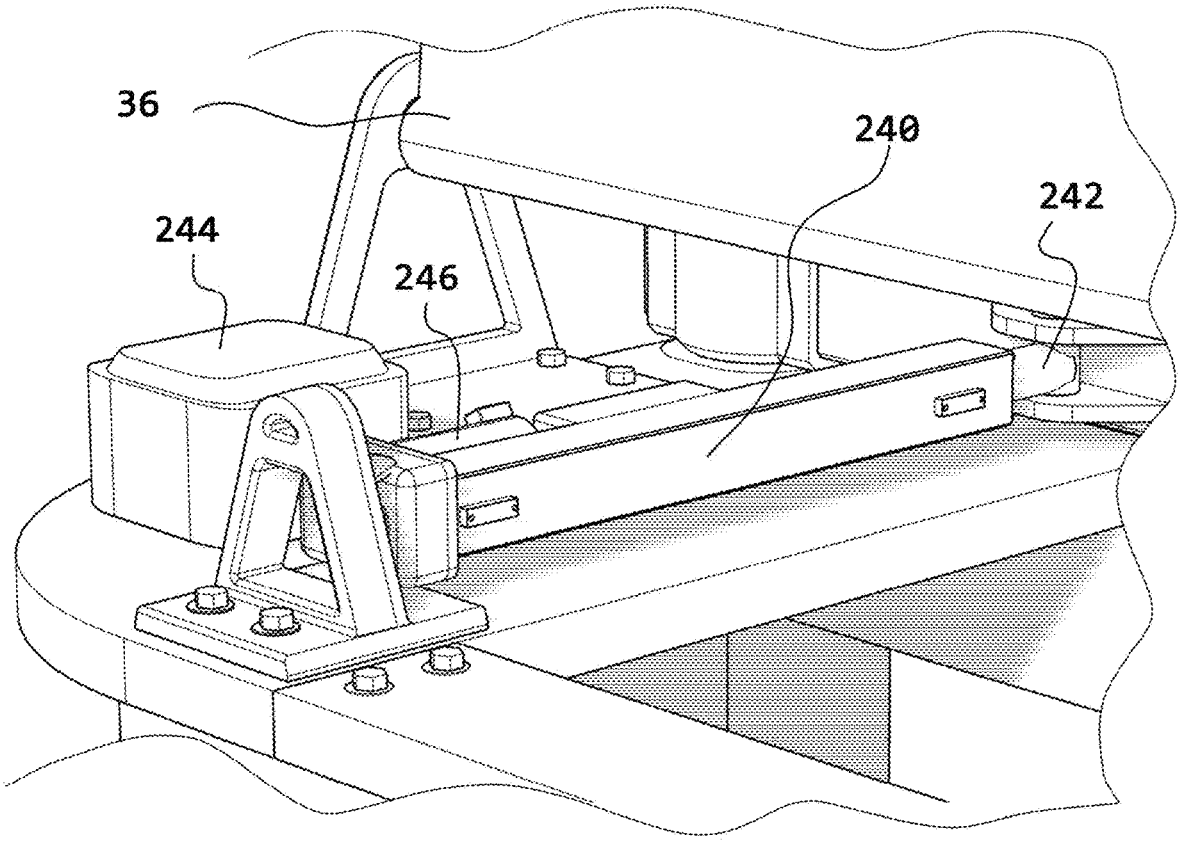
FIG. 9 is a partial perspective view of one of the motorized linear actuators.

FIG. 9 is a partial perspective view of the swing arm embodiment 200 showing powered linear actuator comprised of a motor 246, stationary tube 240 and extendable post 242 powered by DC battery 244. Battery 244 is in turn powered by solar panel 52, 52.

Figure 10:
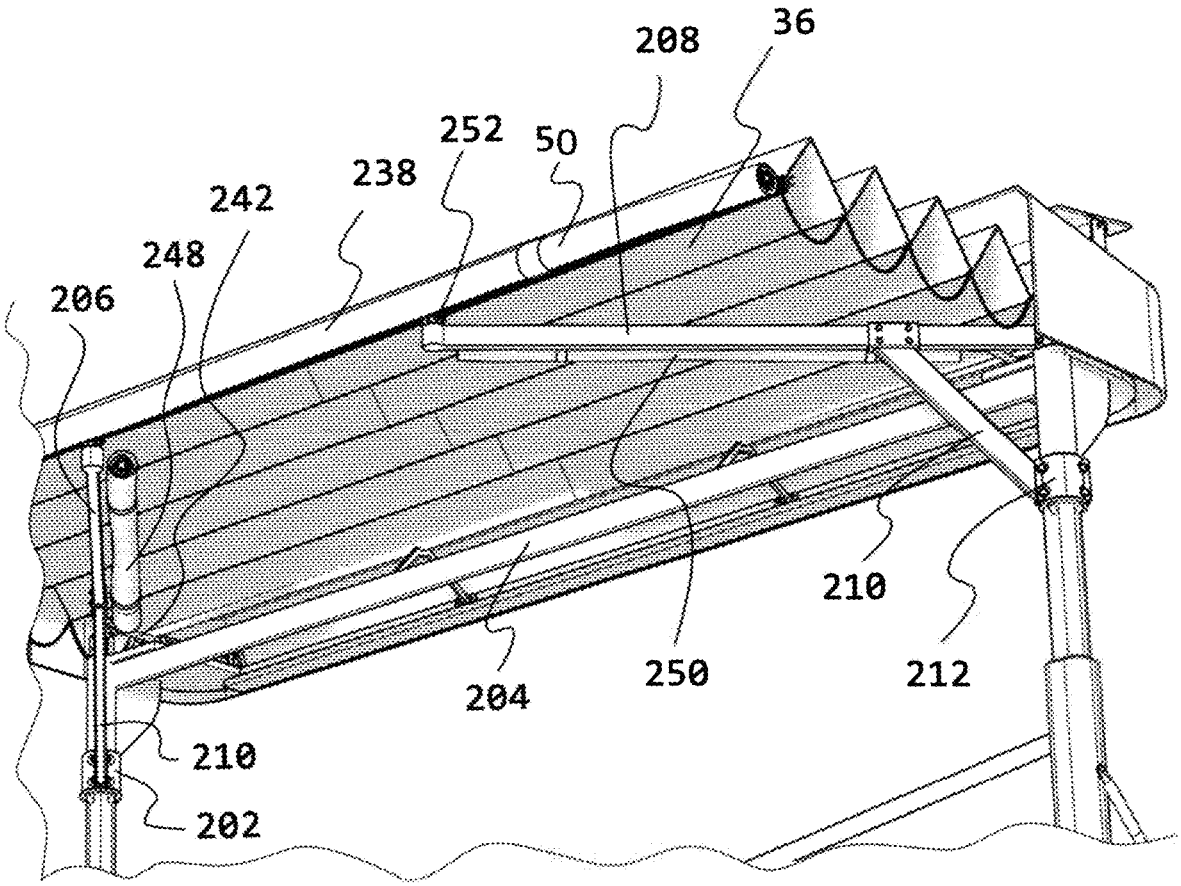
FIG. 10 is a perspective view showing the underside of a partially extended roof member of the rotating swing arm embodiment.

FIG. 10 is a partial perspective view looking up at the underside of roof 36. Extendable post 242 is pushing swing-out arms 206, 208. Telescoping track connectors 252, 253 slide along a track built into front horizontal support member 254 until the roof member 36 is fully deployed as shown in FIG. 12.

Figure 11:
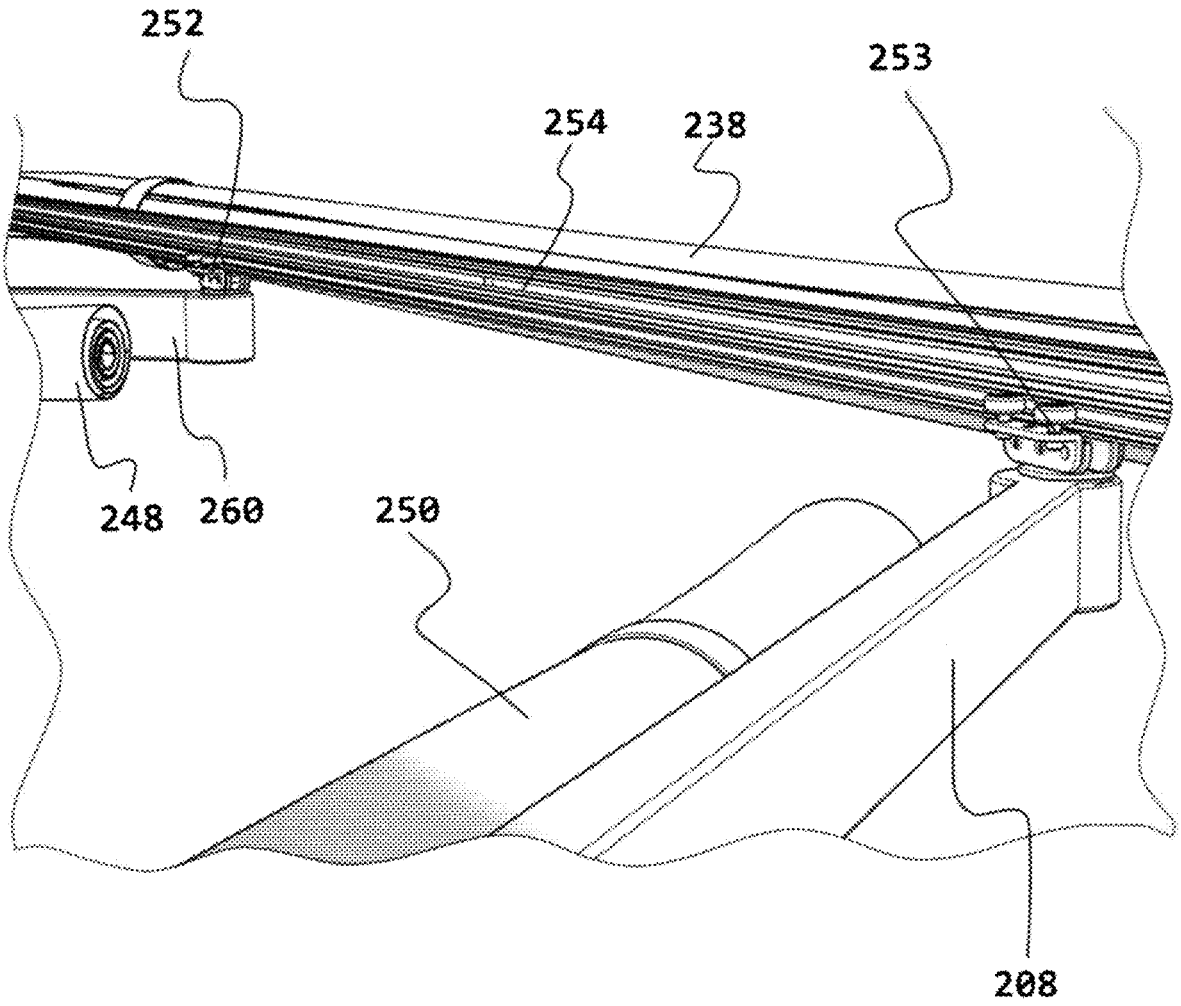
FIG. 11 is a partial perspective view of the left and right rotating arms.

FIG. 11 is a partial perspective view showing telescoping track connectors 252, 253 within a built-in track in the front horizontal support member 254. Curtain rollers 238, 248 and 250 are shown in their rolled and stored position. The curtain rollers 238, 248, 250 are constructed with typical window shade technology that includes a long torsion spring within a roll up tube that allows the curtain to automatically roll back to its storage position when not in use.

Figure 12:
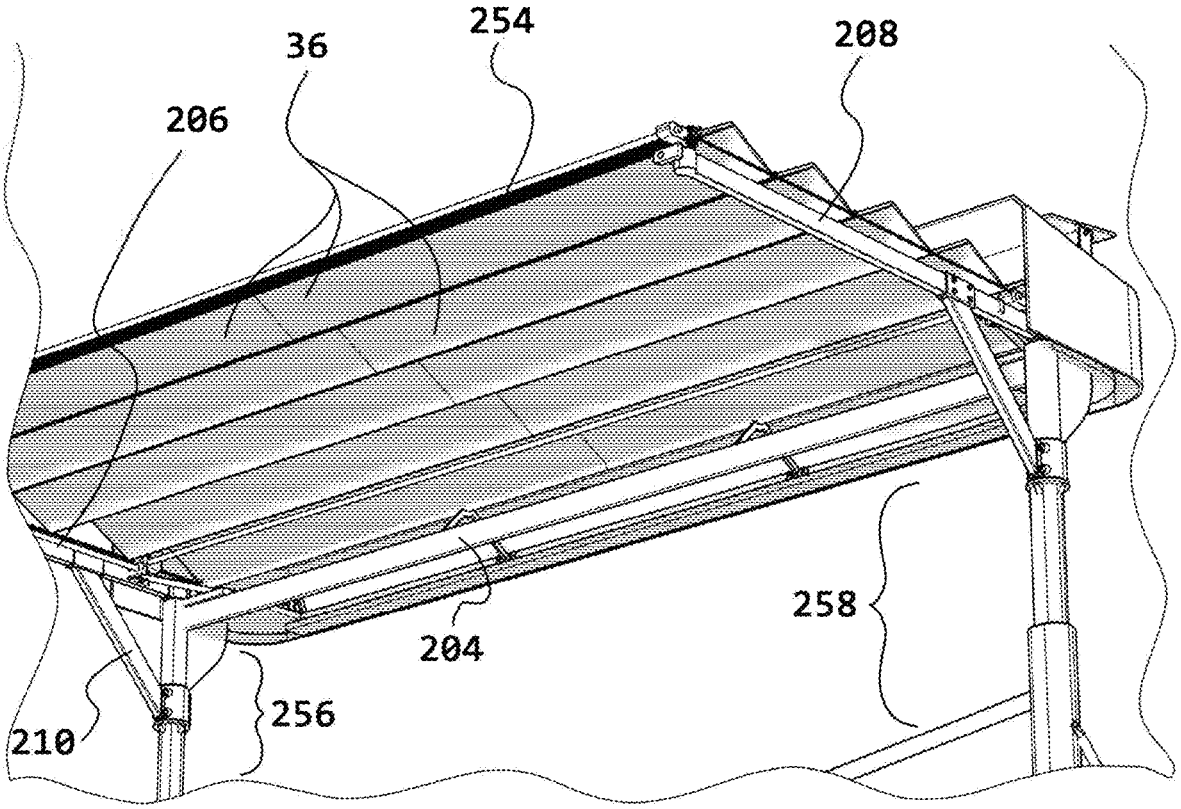
FIG. 12 is a perspective view of the underside of the rotating swing arms embodiment in the fully extended position.

FIG. 12 is a perspective view of the swing arm embodiment of the embodiment 200 with the roof member 36 fully extended. Rear horizontal support member 204 can be clearly seen connecting the right and left horizontal support assemblies 256, 258.

Figure 13:
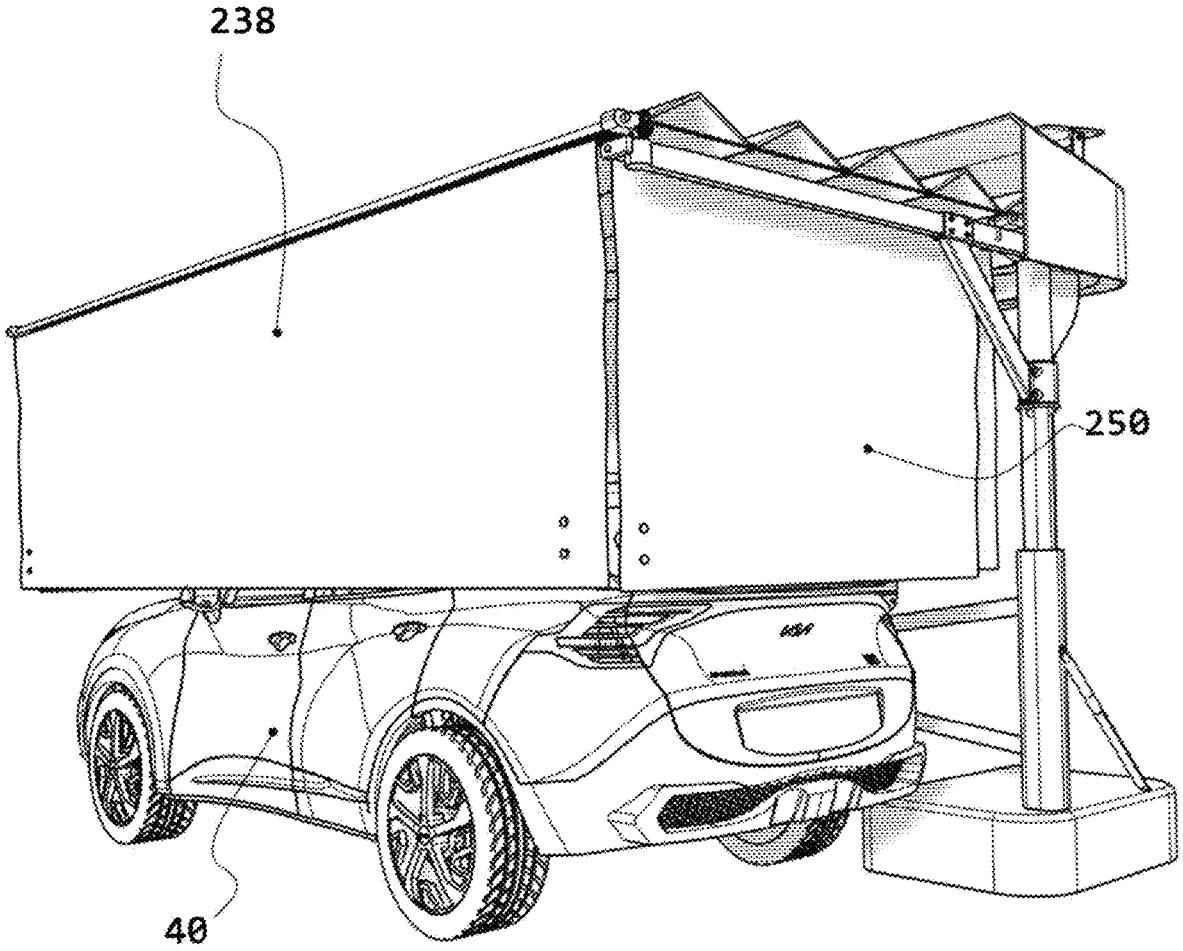
FIG. 13 is a perspective view of the rotating swing arms embodiment with the front and side walls partially deployed.

FIG. 13 shows the front curtain 238 and side curtains 250, 248 pulled down halfway. This configuration is ideal for preventing sun from entering the windows of a vehicle 40.

Figure 14:
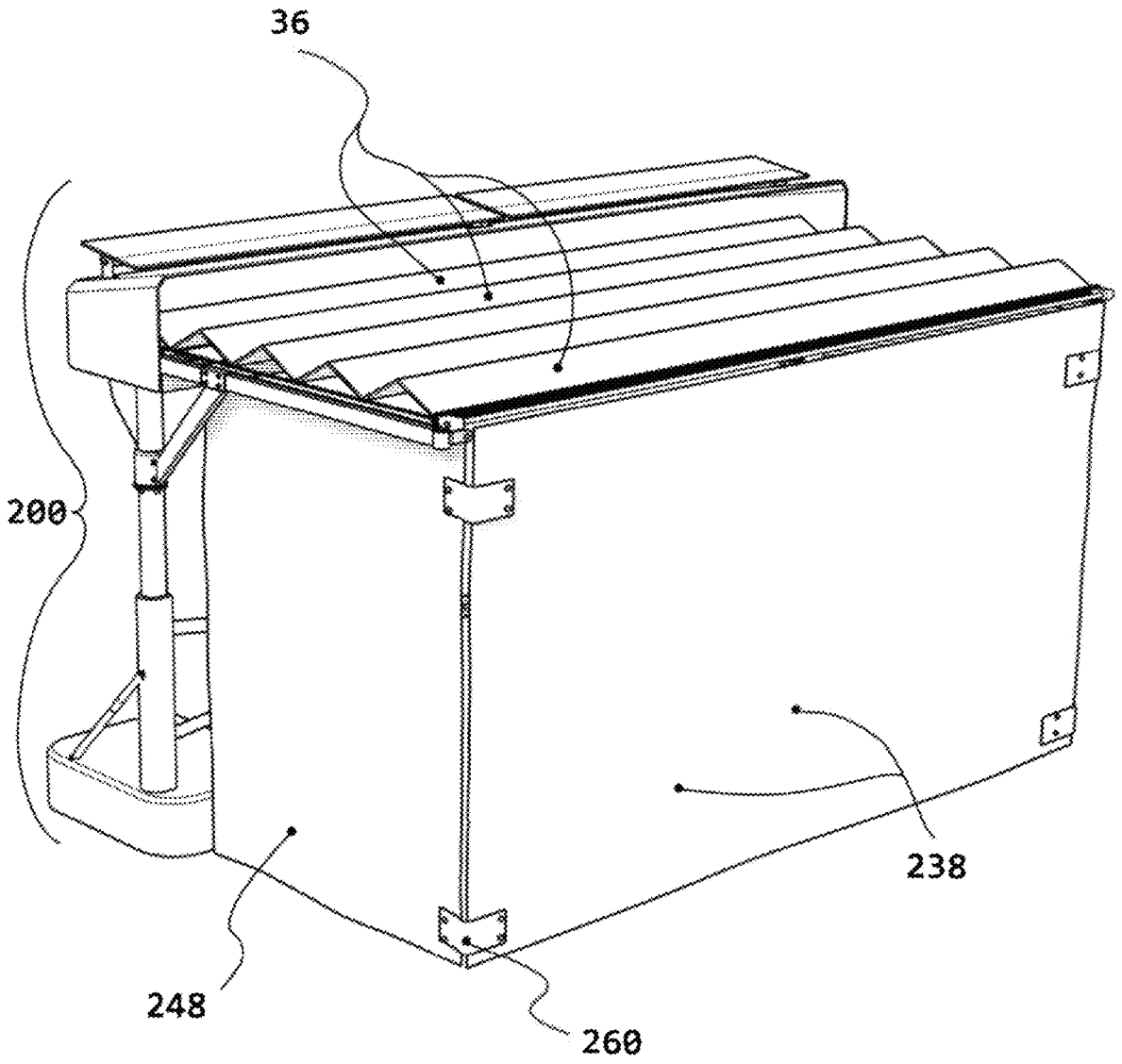
FIG. 14 is a perspective view of the rotating swing arms embodiment with the front and side walls fully deployed.

FIG. 14 shows a perspective view of the swing arm embodiment 200 where the front curtain 238 and side curtains 256, 258 are pulled down to the ground plain. With the addition of a rear curtain which can be permanently installed as described in the first embodiment 100, a vehicle can be completely covered and protected from rain, dirt and sun. Corner attachment members 260 can help prevent the front curtain 238 and side curtains 240, 250 from excessive movement during windy conditions.

Not shown are typically necessary and well-known control system and wiring elements such as limit switches, position sensors and/or similar components, and control and communication system processing units.

While the invention has been described in connection with preferred embodiments, it is not intended to limit the scope of the invention to the particular form set forth, but on the contrary, it is intended to cover such alternatives, modifications, and equivalents as may be included within the spirit and scope of the invention as defined by the appended claims.

In the claims, the word 'comprising' does not exclude the presence of other elements or steps than those listed in a claim. Furthermore, the terms "a" or "an," as used herein, are defined as "one, or more than one." Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are arbitrarily used to distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

What is claimed is:

1. A portable retractably enclosable carport comprising:

a front, a rear, a left side, and a right side;

a vertical support system, the vertical support system comprising:

a plurality of vertical support posts disposed in the rear, each of the support posts comprising:

a weighted base member, wherein each of the base members being a refillable hollow container;

a lower post tube;

an upper post tube comprising a lower end and an upper end, the upper post tube being slidably inserted into the lower post tube whereby the upper end extends adjustably from the lower post tube;

a plurality of reinforcing struts connecting adjacent lower post tubes of the lower post tubes;

a roof assembly cantaleverably attached to the vertical support system comprising:

a roof support structure protective panel;

an extendable roof member, whereby the extendable roof member being capable of covering an area at least seven feet by fifteen feet when fully extended, the extendable roof member comprising a front end bar and rear end bar, the rear end bar fixedly attached to the vertical support system;

a roof member deployment drive mechanism for extending and retracting the extendable roof member;

a front horizontal support member and a rear horizontal support member, wherein furthermore the front horizontal support member comprises a built-in track;

a left side curtain, a right side curtain, a front roll curtain, and a rear fixed curtain; and a protective cover.

2. The portable retractably enclosable carport of claim 1, wherein the roof member deployment drive mechanism comprises:

a plurality of telescoping tube drive mechanisms;

a plurality of telescoping tube assemblies each comprising a drive end and a roof member attachment end;

each telescoping tube assembly roof member attachment end being attached to the extendable roof member front end bar;

each of the telescoping tube assembly drive ends being attached to one of the telescoping tube drive, mechanisms wherein the tube drive mechanism when activated comprises either an extension direction, whereby the extendable roof member being extended, or a retraction direction, whereby the extendable roof member being retracted;

a plurality of vertical posts, upwardly extending from the roof rear horizontal support member wherein each of the vertical posts comprises a spring reel assembly, wherein each spring reel assembly comprises a retractable cable; and wherein an extendable end of the retractable cable being attached to the front end bar of the extendable roof member thereby providing additional support to the extendable roof member when the roof member is extended.

3. The portable retractably enclosable carport of claim 2, wherein each of the plurality of drive mechanisms comprises an electric motor.

4. The portable retractably enclosable carport of claim 2, wherein the extendable roof member, and the left side curtain, and the right side curtain each extend and retract like an accordion.

5. The portable retractably enclosable carport of claim 1, wherein the roof member deployment mechanism comprises:

a plurality of swing out arms comprising a left swing out arm and a right swing out arm, each of the arms rotatably supported by a strut and a collar disposed on the upper post tube;

a plurality of motorized swing out arms linear actuators, wherein each of actuators comprises an actuator motor, a stationary tube, an extendable post disposed within the stationary tube and a roof member drive end, wherein the extendable post is extended and retracted by the actuator motor;

wherein furthermore each of the extendable posts being slidably attached to the track;

the left side curtain being attached to the left swing out arm, and the right side curtain being attached to the right swing out arm, each of the side curtains deployment mechanism comprising a torsion spring and a curtain material rollup tube; and the left swing out arm and the right swing out arm each being slidably attached to the extendable roof member; wherein the roof member being extended when the swing out arms swing from the rear towards the front and the roof member being retracted when the swing out arms swing from the front toward the rear.

6. The portable retractably enclosable carport of claim 1, further comprising a power and control system comprising:

a remote user operated commands and status feedback transceiver;

a rechargeable battery;

a plurality of solar photovoltaic panels with integrated battery charging subsystem;

a power line attachable battery charging subsystem; and a control system controlling the plurality of motors to extend and retract the extendable roof member, the control system comprising a structure mounted command and status transceiver communicating with the user operated command and status transceiver.

* * * * *